US006030132A

United States Patent [19]

Harman et al.

[11] Patent Number: 6,030,132

[45] Date of Patent: Feb. 29, 2000

[54] DOCUMENT CONTROL PAGE INTERFACE

[75] Inventors: James L. Harman, Southport; Patrick Rolling, Cheshire, both of Conn.

[73] Assignee: Pitney Bowes Inc., Stamford, Conn.

[21] Appl. No.: 08/885,557

[22] Filed: Jun. 30, 1997

[51] Int. Cl.[7] ..... B41J 5/30

[52] U.S. Cl. ..... 400/62; 400/76

[58] Field of Search ..... 101/91; 400/62, 400/68, 82, 76, 61; 209/900

[56] References Cited

U.S. PATENT DOCUMENTS 5,628,249 5/1997 Cordery et al. ..... 101/91
5,650,934 7/1997 Manduley ..... 364/478.08

*Primary Examiner*—Ren Yan
*Attorney, Agent, or Firm*—Charles R. Malandra, Jr.; Michael E. Melton

[57] ABSTRACT

The invention is a system and method for producing a mail piece wherein the system includes at least one printer for printing documents and envelopes in response to signals generated by a host computer under control of an application program. In addition, the system includes: a mail finishing unit which forms the mail piece from the envelopes and documents; and, a control unit which controls the finishing unit to form each individual mail piece within the set of produced mail pieces. Each individual mail piece is comprised of attributes specific to that mail piece. The control unit receives signals generated by the host computer, parses the signals received therefrom, and extracts control signals embedded therein by the host computer. The control signals identify the individual attributes associated with each individual mail piece. The control unit responds to the extracted control signals by generating finishing control signals for the finishing unit to create the individual mail piece. The control unit is further programmed to extract print signals for controlling the print unit. The system user may designate a particular format or protocol to a document page which in turn identifies the page to the control unit as a control page, containing control signals whose elements are not to be printed but which in turn will direct the system in the production of the corresponding document which is to be included within the mail piece.

13 Claims, 4 Drawing Sheets

DOCUMENT CONTROL PAGE INTERFACE

FIELD OF THE INVENTION

This invention relates generally to control of features and components of a mail processing system, and more particularly to a programmed arrangement for interfacing between an application program running on a computer and a control program for a mail finishing process of the mail processing system. More specifically, the invention relates to an interface program, which receives from an application program data formatted as a control page. The interface program transfers the control page to a known printer driver along with information alerting the driver not to print the control page data but, instead, to generate control commands therefrom for devices such as sheet folders, sheet feeders, sorters, inserters and envelope printers of the mail processing system.

BACKGROUND OF THE INVENTION

Systems for printing and processing of mail pieces, including finishing of the mail pieces, are known in the art. For example, U.S. Pat. No. 5,278,947 to Balga, Jr. et al., the contents of which are incorporated herein by reference, discloses an automatic printing system for mail pieces, including an envelope feeder, a sheet feeder, a printer and a stacker, for example. In the disclosed system, the envelope feeder and sheet feeder are controlled to feed specific media to the printer which is controlled to print an envelope either before or after a sheet. The disclosed system does not provide for specific inserts, envelope printing or other finishing of individual mail pieces in conjunction with instructions which are easily modifiable by a user, and does not permit a user to select specific operations to be performed with specific mail pieces by simple addition of information to the data stream sent to a printer driver.

Merging of information into a single stream, for printing and mailing of different promotional items, is disclosed in U.S. Pat. No. 5,321,604. While items from many different promotions are commingled into a single printing stream, the disclosure fails to provide a system capable of individualizing mail piece contents by providing specific inserts in conjunction with a known data stream sent to a printer.

Under some circumstances it is desirable to be able to control both the subject matter to be printed and the physical contents of mail pieces being generated. For example, where a large number of individual letters, bills, or the like are printed in a single operation, letters of different sizes may be appropriate for different addressees, and it may be desirable to provide different inserts in mail pieces to different individuals. That is, it would be advantageous to have the ability to provide individual control and customization of mail pieces, on a piece by piece basis, as desired.

A capability to implement such individualization is frequently advantageous, as for example in a mailing of notification of alumni dues or notices to a large number of alumni of an educational institution, when a customized letter is more likely to elicit a more favorable response. Thus, where some alumni are known to be interested in a particular sport, such as football, while others are known to be interested in artistic performances, it is helpful to provide inserts identifying a schedule of artistic performances in letters sent to the latter and to provide inserts identifying a football schedule to accompany the same letters sent to the former. Similarly, it may prove more fruitful to solicit contributions when the letter to the former is printed on stock cut and shaped to resemble a football while the letter to the latter is printed on stock resembling a violin.

Additionally, when monthly statements are sent to a large number of clients, it is helpful and less wasteful to send a return envelope only to those clients having an outstanding balance due while sending no such envelopes to clients without an outstanding balance. Still further customization of mail pieces may be provided by varying the information printed on the envelopes from one piece to the next. For example, depending on the recipient's account status, it might be appropriate to print "Your account is past due" as a message line on some of the envelopes by not on others. Still further, in some circumstances it may be beneficial to vary the return address from one envelope to the next.

U.S. Pat. No. 5,628,249 to Cordery et al., the contents of which are incorporated herein by reference, discloses an apparatus for producing mail pieces, including plural printers for separately printing documents and envelopes for example, along with a mail finishing unit which, among other functions, inserts into envelopes the printed documents as well as pre-printed inserts to form the finished mail pieces. A host computer controls the apparatus in accordance with a single stream of job data, including headers defining mail piece attributes, as well as document and address data. The disclosed apparatus partitions the data stream and, in accordance therewith, controls the printers to separately print the documents and envelopes.

More particularly, a printer controller of the disclosed apparatus parses the job data received from the host computer and sends attribute data to a controller of the mail finishing unit while sending document data to a document printer engine. The finishing unit controller then controls production of the mail pieces in accordance with the data, by controlling operation of a number of known elements of a mail piece preparation system.

The finishing unit includes such elements of a mail piece preparation system as a flap opener, a document accelerator, an accumulator, an insert feeder, a folder, an inserter, and other devices known in the art.

The printer controller and finishing unit controller execute various software modules resident therein in accordance with the job data from the data stream, which includes both a job header including default attribute data, and a mail piece header including specific mail piece attribute data. A mail piece attribute generator converts received codes into commands for operation of the various elements, thus permitting preparation of mail pieces having different lengths, different contents, and with different inserts in a single mail piece production run.

A disadvantage of the system disclosed in the '249 patent relates to the manner of providing data to the printer controller and finishing unit controller. Specifically, in the system disclosed therein a driver receives document data from an application program such as a word processor, and accesses processing attributes and job data from a data store.

However, the data in the store does not provide for customization or individualization of the mail pieces. That is, only default data values to be used for each mail piece are stored therein, so that the mail pieces produced in a mailing job controlled thereby will be produced in an identical manner.

There is thus a need in the prior art for an arrangement for customizing and individualizing generation of mail pieces in a single mailing operation.

There is a more specific need in the prior art for method and apparatus for providing a variable number of additional inserts to be included in a mail piece, with different inserts or different numbers of inserts being included in different mail pieces generated in a single mailing operation.

There is still a more particular need in the prior art for an arrangement permitting simplified user intervention in a mailing operation to control various mail finishing devices, such as folders, sheet feeders, inserters, cutters and the like, without disrupting smooth flow of operations in a mass mailing.

It is accordingly an object of the invention to implement a mail producing operation which produces mail pieces having varying attributes. It is a more specific object of the invention to provide an arrangement for customizing and individualizing mail pieces produced in a single mail producing operation.

It is still a more particular object of the invention to provide an arrangement for including a variable number of inserts to be included in a mail piece, so that different inserts, or different numbers of inserts, are included in different mail pieces generated in a single mail producing operation. It is yet another object of the invention to permit simplified user intervention in a mailing operation to control various mail finishing devices, such as folders, sheet feeders, inserters, cutters and the like, without disrupting smooth flow of operations in a mass mailing.

SUMMARY OF THE INVENTION

The above objects are achieved in accordance with the present invention by means of an apparatus and method for producing mail pieces, wherein the apparatus includes a printer, for printing a plurality of documents and envelopes in response to signals generated by a host computer under control of an application program. A mail finishing unit forms a plurality of mail pieces from the documents and the envelopes. A control unit controls the mail finishing unit to form an individual one of the plurality of mail pieces with individual attributes. The attributes of any one mail piece may be different from attributes of others of the mail pieces, so that each mail piece may have individual attributes assigned thereto. The control unit is connected to receive the signals generated by the host computer and is programmed to parse the signals from the host computer and to extract therefrom control signals generated under control of the application program. The control signals identify the individual attributes for the individual one of the plurality of mail pieces. The control unit responds to the extracted control signals by generating finishing control signals for the mail finishing unit to form the individual one of the plurality of mail pieces having the individual attributes assigned thereto. The control unit is further programmed to extract print signals for the print unit from the signals and to provide print control signals to the print unit responsively thereto.

In accordance with the invention, the application program may be a word processor, which outputs document pages for printing by the printer. A user may provide a particular format or protocol to a document page, preferably to the first page output by the word processor, which designates that page to the control unit as a control page including the various control signals. Upon recognizing the control page, the control unit extracts the same from the word processor output, so that the printer does not print, or attempt to print, the elements thereof as text.

In accordance with another feature of the invention, the control unit may be provided as a software component of a printer driver used to drive a printer in response to the output of the word processor or other application program, or may be provided separately from the printer driver.

In accordance with still another aspect of the invention, where the application program is aware of, and interacts with, the finishing unit, there may be provided a display and an input for interactive selection of the attributes for a particular mail piece by a user. Thus, while a word processor requires the user to generate a control page, an aware application does not require the user to generate such a control page and may interactively display specific attributes for user selection.

In accordance with the invention, there is accordingly provided an arrangement for individual control of a mail finishing device, to implement individual operations for finishing individual mail pieces in accordance with predetermined control information provided by a user to an interface module.

In accordance with another feature of the invention, individual control of several mail finishing devices is implemented by providing control information and document data from an application program to a printer driver, which parses the same and sends the control information to an appropriate mail finishing device while forwarding only the document data to a printer.

In accordance with still another feature of the invention, an interface module, which may be in the form of a printer driver, recognizes a control page generated by an application program as one of a plurality of pages to be printed, parses the control page and transfers information from the control page to individual mail finishing devices, such as folders, inserters, feeders and the like, and drives a printer only in accordance with document data included in other pages generated by the application program, thus preventing the printer from printing the control page.

These and other objects, features and advantages of the present invention will become readily apparent to those skilled in the art from the following description and drawings, wherein there is shown and described a preferred embodiment of the invention, simply by way of illustration and not of limitation of one of the best modes (and alternative embodiments) suited to carry out the invention. The invention itself is set forth in the claims appended hereto. As will be realized upon examination of the specification and drawings and from practice of the same, the present invention is capable of still other, different, embodiments and its several details are capable of modifications in various obvious aspects, all without departing from the scope of the invention as recited in the claims. Accordingly, the drawings and the descriptions provided herein are to be regarded as illustrative in nature and not as restrictive of the invention.

BRIEF DESCRIPTION OF THE DRAWINGS

The accompanying drawings, incorporated into and forming a part of the specification, illustrate several aspects of a preferred embodiment of the present invention and, together with the description, serve to explain the principles of the invention. In the drawings.

DETAILED DESCRIPTION OF A PREFERRED EMBODIMENT OF THE INVENTION

Figure 1:
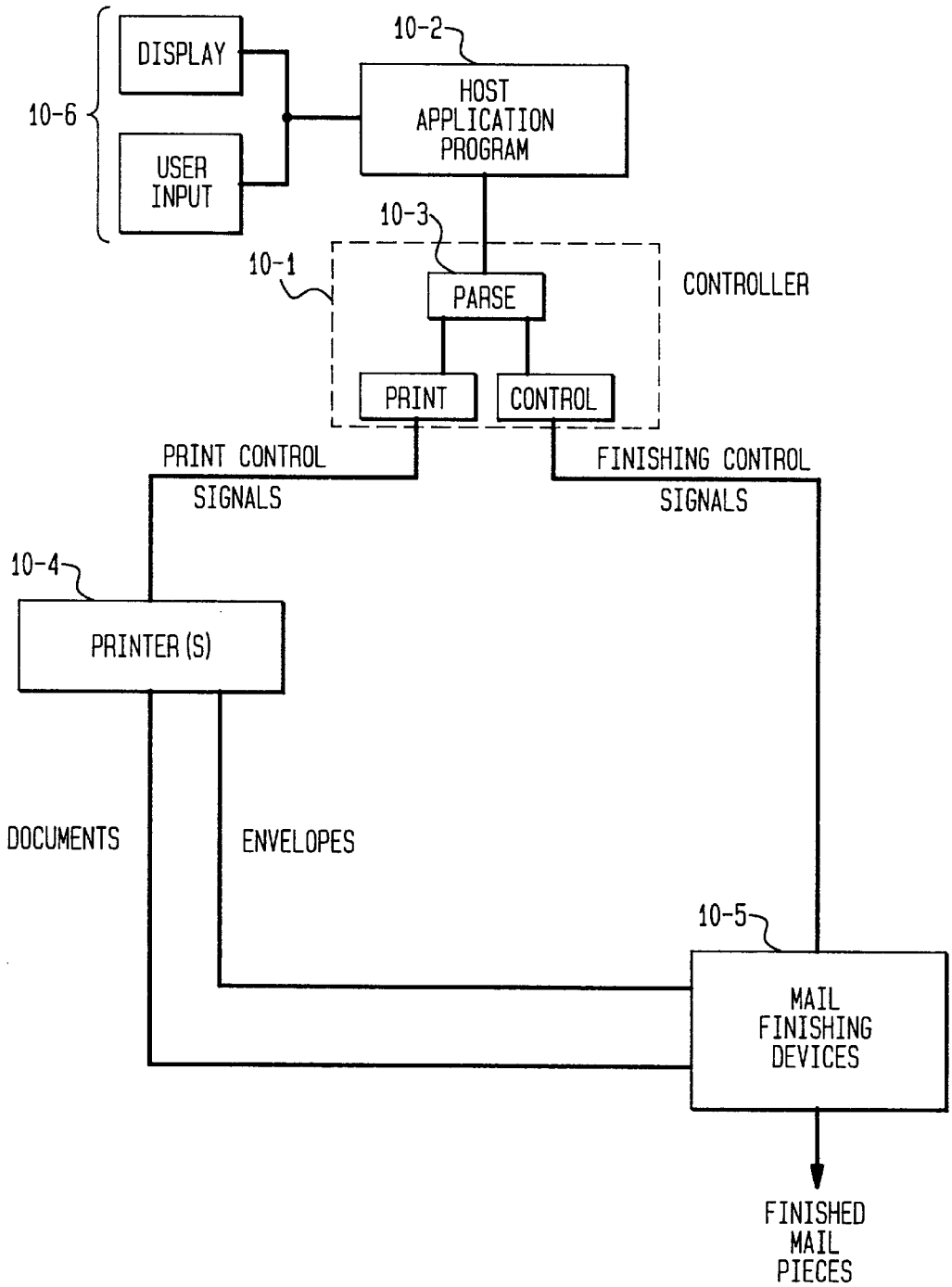
FIG. 1 shows an arrangement for controlling a mail finishing apparatus in accordance with the invention.

Referring now to the drawings, FIG. 1 shows the concepts of the present invention. As illustrated therein, the invention provides an arrangement wherein a controller 10-1 responds to (document) signals generated by a host application program 10-2 being executed on a host computer.

The host application program may be a commercial word processing program, such as that sold under the trade name "Word" by Microsoft Corporation. Of course, the host application program may be any other word processing program such as "Wordperfect", "AMIPro" and others, available from other vendors, or may be a spread sheet or data base management program, or any other program which generates document print signals.

The controller, which may be a separate component or may be a software module included in a printer driver, includes a parsing interface, shown as parse element 10-3. Such a parsing interface between the application program and the printer driver is a significant feature of the invention, and can be located inside or outside of the printer driver. It is contemplated that in modifications of the presently contemplated best mode of the invention the parsing interface may be moved outside of the driver, in a stand alone module using the latest available technology for Windows (or other operating system), such as ActiveX or OLE automation. It will be essential, however, that this module, parsing element 10-3, communicate, either directly or indirectly, with the printer driver.

Parsing element 10-3 differentiates between portions of the document signals generally corresponding to print operations to be implemented by printer 10-4 and other portions generally corresponding to control of any of a number of mail finishing devices 10-5.

Upon extraction of the print and control signals from the document signals by parsing element 10-3, the print and control signals are converted to print control signals and finishing control signals, corresponding to signals for driving printer 10-4 and the mail finishing devices 10-5.

Printer 10-4, though referenced in the singular, may include one or more separate printers, such as separate printers for producing documents and envelopes, and mail finishing devices 10-5 may include the various envelope feeders, sheet feeders, stackers, folders and other units known in the art. Thus, devices 10-5 receive the documents and envelopes produced by printer 10-4 and, in response to the finishing control signals provided by controller 10-1, implement the various finishing operations thereon to produce the finished mail pieces. As previously noted herein, the finishing devices may implement a number of operations such as selecting individually identified pre-printed inserts to be added to individual envelopes in addition to the printed document, providing individualized folds in differently sized envelopes for individual mail pieces, inserting return envelopes in specific mail pieces, etc.

Significantly and advantageously, parse element 10-3 of controller 10-1 provides to printer 10-4 only print control signals, thus eliminating a possibility that the printer may respond to the control signals included in the document signals produced by the host application program 10-2 and may generate printed material which, in fact, does not correspond to the document intended to be printed.

As also shown in FIG. 1, an interactive user-interface 10-6 is provided, which permits a user to view the specific attributes of a mail piece on a display and to modify the specific attributes by inputting attribute data via a user input, such as a keyboard, a mouse, or other input device. For a commercially available word processing application program, the user may input a control page conforming to a predetermined document format as a first page of the document, including therein the various attributes of the mail piece to be generated with the document. The word processor responds to such a control page by generating specific document signals which, upon recognition by parsing element 10-3 of controller 10-1, are extracted from the document signals to provide the control and finishing control signals hereinabove described. However, application programs may be produced which include the capability to generate specific control signals to implement specific finishing operations for mail pieces, i.e., which are aware of the finishing operations to be implemented in accordance with the invention. As will be appreciated by those skilled in the art, such applications thus are capable of generating the control pages having the predefined document format in response to straightforward interaction with the user. Thus, the application may generate a display providing a number of choices for the user who, rather than generating the control format, may then simply select the desired attributes for the mail pieces from the displayed choices.

Figure 2:
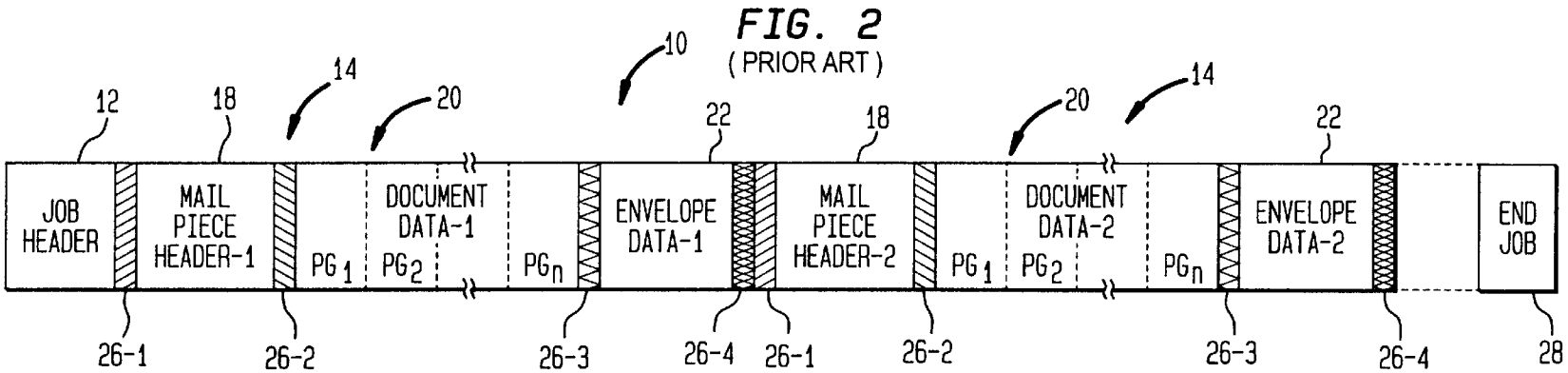
FIG. 2 (PRIOR ART)
FIG. 2 is a schematic representation of job data defining a mailing job.

FIG. 2 shows a schematic representation of job data 10 for producing a mailing job including a sequence of mail pieces in accordance with the present invention. As described in U.S. Pat. No. 5,628,249, such job data 10 may include a job header 12 and a sequence of individual mail piece records 14, each corresponding to individual attributes of an individual mail piece to be produced in the job. Job header 12 includes and defines any default attributes which are applicable to all the mail pieces in the job. In different mailing jobs, such default attributes may include the number of document sheets to be accumulated for each of the mail pieces, identification of any common pre-printed inserts to be added to the document sheets for each of the mail pieces, the manner in which the accumulated sheets are to be folded, whether or not a BRE (i.e., business return envelope) is to be inserted into the envelope with the folded accumulation, and whether or not the mail piece is to be moistened and sealed. Job header 12 also defines a job type, as well as other features, which may be readily ascertained upon reference to the patent whose disclosure is incorporated herein.

Each of records 14 corresponds to one mail piece to be produced, and includes a mail piece header 18, as well as a document data field 20 and an envelope data field 22, for example relating to data to be printed on the document and envelope. Mail piece header 18 includes the same (or a subset of the) data elements included in job header 12 to define the mail piece attributes specific to the corresponding mail piece.

Fields, 18, 20 and 22 are separated by unique separators 26-1, 26-2, 26-3 and 26-4, and data 10 also includes an End of Job marker 28 to identify the end of the job.

While many mailing jobs may not vary the attributes of mail pieces, the present invention specifically addresses the situation wherein such individualized attributes are to be provided to the individual mail pieces, and provides the following description of a manner of implementing the same.

Figure 3:
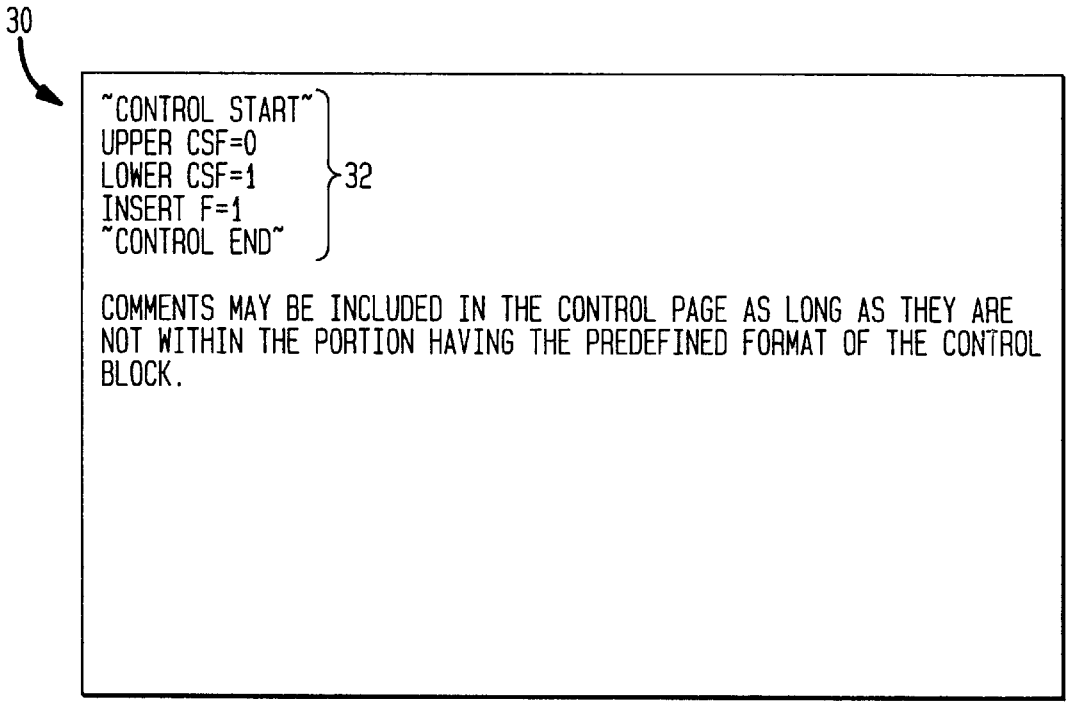
FIG. 3 shows a control page to be included in the job data of FIG. 2 according to the present invention.

Referring now to FIG. 3, there is shown a "Control Page" 30 providing the desired mail piece customization information to the parsing interface of the invention. The control page is a feature of the invention used to pass the mail finishing information along to the controller 10-1, and is preferably implemented as a specially formatted page included as the first page of each document to be printed by printer 10-4. The control page is intercepted by parse element 10-3 and extracted from the document signals, so that it is not printed. The control page uses information from the host application program, output as part of the document signals generated thereby, to control operation of the feeders, inserters and other finishing devices, and may also be used to specify envelope data.

As shown in FIG. 3, the control page 30 includes a control block 32, providing control signals which are presented therein in a predefined format recognized by the parse element 10-3. The control block is always delimited by predefined, arbitrary, character sequences (or sequences of symbols, data or the like). In accordance with the presently preferred embodiment of the invention, the sequence ~Control Start~ begins a control block and the sequence ~Control End~ ends the control block. Upon recognizing the begin sequence, parse element 10-3 extracts the ensuing data included in the control block 32, up to the end sequence, to generate the appropriate control signals from which the finishing control signals are produced.

While it is possible that the control page 30 may be included anywhere in the document signals generated by the application program, preferably control page 30 is always the first page of the document, thus avoiding potential problems (such as page numbering errors) in the printed document.

The illustrative control information included in control block 32 of FIG. 3 includes the commands UpperCSF, LowerCSF, and InsertF. These commands control the operation of Upper and Lower Cut Sheet feeders and of an Insert feeder respectively, with a 1 value in the commands indicating a feed operation and a 0 value indicating no feed. The details of the Control Page commands are summarized below. As noted in FIG. 3, it is possible to include comments on the control page 30, above and/or below the control block 32 including the control information. As such comments occur before the ~Control Start~ begin sequence and/or after the ~Control End~ end sequence, parse element 10-3 ignores the same, while having intercepted the entire page on which the control block 32 is detected and thus having prevented the comments from being printed by printer 10-4. Inasmuch as the control page is part of the document (e.g., part of the word processor document), a standard word processor having no specialized features may be used to produce the same, as a (first) page of the document, in accordance with standard typing of a user (or may be otherwise inputted by the user).

The data for the Control Page would normally be controlled by data from fields in a data base used for the mailing job. These fields usually will not contain the required feeder commands. However, most word processors provide a way to use the field data to generate the commands. In Microsoft Word, IF fields may be used to accomplish this. Details and examples of using IF fields are given on pages 697–702 of the Microsoft Word 6 Users Guide, for example. In the example of FIG. 3, the control page might appear as follows:

```
~Control Start~
{IF {MERGEFIELD ATH_PREF} = "F"
"UpperCSF=1" "UpperCSF=0"}
{IF {MERGEFIELD ATH_PREF} = "S"
"LowerCSF=1" "LowerCSF=0"}
{IF {MERGEFIELD BAL_DUE} > "0" "InsertF=1" "InsertF=0"}
~Control End~
```

It is noted that the curly brackets { } are not typed. Rather, the above is what is displayed upon selecting Tools/Options/View/Show Field Codes (or hitting Alt-F9).

The following table illustrates some of the commands which may be used on Control Pages, and shows the default actions to be taken if the command is missing. Of course, other commands may be added, and actions taken in response to the illustrated commands may be modified, without departing from the inventive concept.

| Command | Data Values | Function | Action if Missing |
|---|---|---|---|
| ~Control Start~ | — | Marks beginning of control block | Error |
| ~Control End~ | — | Marks end of control block | Error |
| UpperCSF= | 0: Don't feed<br>1: Feed | Controls upper cut sheet feeder | Don't feed |
| LowerCSF= | 0: Don't feed<br>1: Feed | Controls lower cut sheet feeder | Don't feed |
| InsertF= | 0: Don't feed<br>1: Feed | Controls an Insert Feeder | Don't feed |
| MsgLine= | 1 line text string | Prints text as a message on an envelope | Use message from envelope layout |
| Return Start | 1 or more text lines below command | Prints text as a return address on the envelope. | Use return address from envelope layout |
| Return End | — | Marks end of return address | Error if there has been a Return Start |
| Destination Start | 1 or more text lines below command | Prints text as destination address on the envelope | Use address from document |
| Destination End | — | Marks end of destination address | Error if there has been a Destination Start |
| ZipBreak= | 1: First piece of a new group<br>0: Not first piece | Used to mark a tray or package break for presorted mail. First piece is offset in stacker. Also, in case pieces need to be regenerated after a jam, system ensures all pieces are stacked on the correct side of the break. | No break |

The data generated in accordance with the commands included in the control block of the control pages associated with various individual documents are thus used as the various mail piece headers 18 in the job data shown in FIG. 2.

The standards used to define the control page may vary without departing from the invention. However, it is presently contemplated that where a control page is produced, the very first page of a document generated by a host application will be the control page, and that the page will be ended by a page break. Control token strings are included in the control field. These tokens indicate the specific job actions to be implemented. The control tokens can be placed using merge capabilities of a word processor as a host application, which sends the same to the printer driver. Upon execution of the print merge, for example, the parse element of the invention recognizes the same and operates as described herein. When the controller 10-1 includes a printer driver, and when a separate printer driver is not used, the included driver itself will recognize the control page and parse all control tokens from the print stream data.

Host application programs may be designed to work and cooperate specifically with the inventive controller. Such applications, which are "aware" of the features of the invention, may thus include facilities for implementing code to automatically generate and print a control page having applicable token strings, selected by interactive communication with a user for example. Thus, for such applications the user may be guided to select among a plurality of choices, the selection then causing the aware application to access the parsing capabilities of the inventive controller by generating the appropriate control tokens for the control page. The control page may thus be automatically generated before printing each address record.

Indeed, the invention as disclosed makes it possible for an application, whether a word processor or another type, to generate a control page without generating a document to be printed, inasmuch as the invention does not rely on presence of succeeding printable document pages for its operation. This feature makes it possible to control mail jobs by providing for selective inserting, for example, when document printing is not required. Thus, a mail batch may be implemented which selectively combines selections from a preprinted set of inserts, selected in accordance with various criteria of benefit to a user.

Errors may be attended to in a number of ways. For example, the controller may be programmed to abort printing when conflicting commands are present. Other syntactical features may provide for a page which is supposed to be a control page but which is missing a Control Start token to be considered as a document page to be printed. If a control page includes a Control Start token but is missing a Control End token, the controller may be programmed to abort printing. If a line of message text is too long, an error message will be displayed to indicate that the message line will not be printed.

Once a document or report has been set up with a control page, a mailing job may be merged, printed or run in a standard fashion. However, some special settings may be provided on a setup screen displayed on the user interface 10-6. For example, there may be provided an option "Document Includes Control Page" for selection by a user when a control page is included. Selection of this option would signal the parse element 10-3 to look for a control page on each document. The number of pages to print (not including the Control Page) may also be selectable by the user. Thus in the example of FIG. 3, where control page 30 precedes a one page letter the number "1" would be selected under Page Count. If selective inserting is used, the "InsertF=" command would be used in the control page to indicate how many sheets are to be inserted. The command may include an additional field to identify specific sheet feeders to be used. This feature is useful when a plurality of sheet feeders are available, for inserting any of a plurality of preprinted inserts in the finished mail piece.

Figure 4:
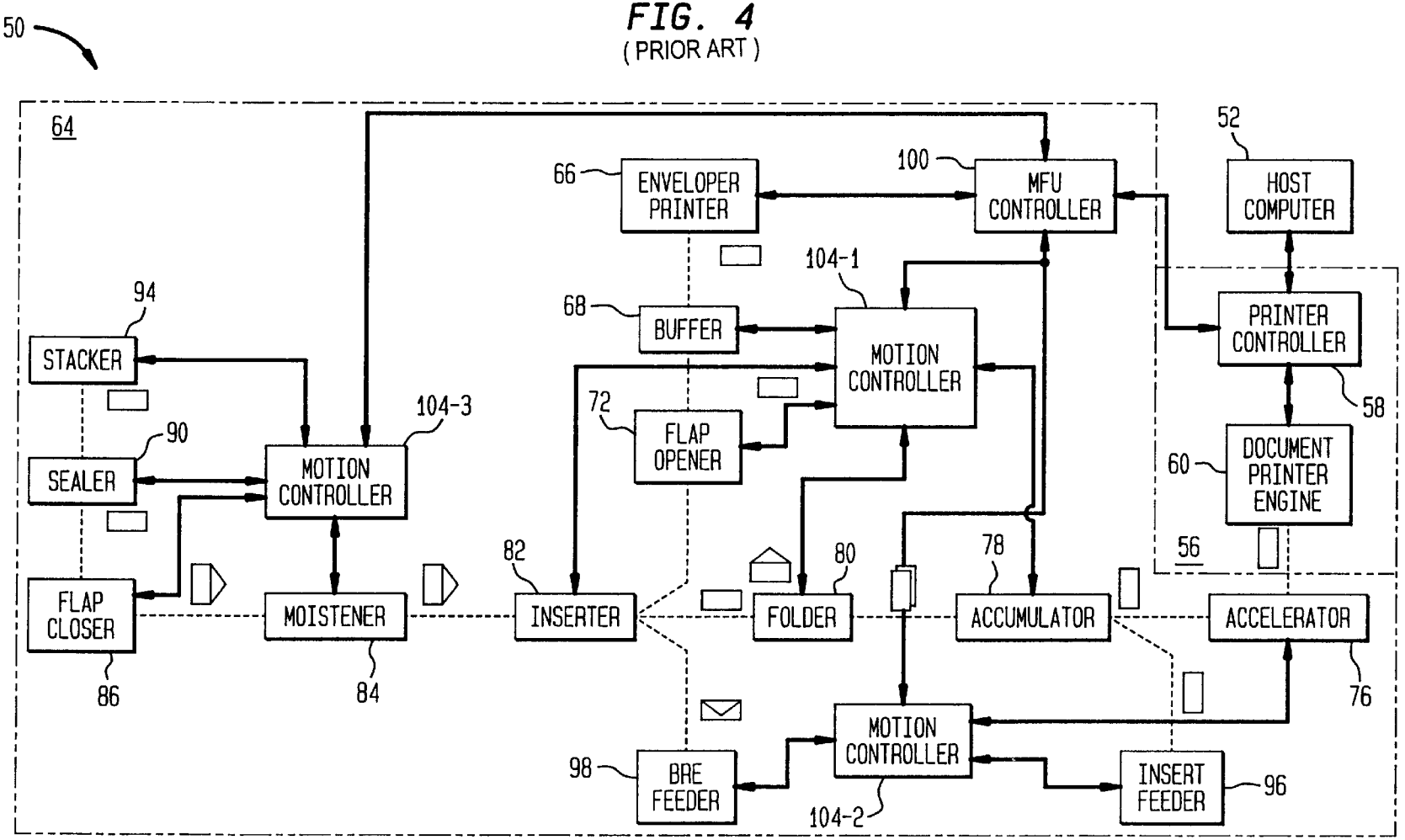
FIG. 4 (PRIOR ART)
FIG. 4 shows a known mail finishing apparatus.

For completeness, FIG. 4 shows a known mail finishing apparatus as more fully described in the aforementioned U.S. Pat. No. 5,628,249. As disclosed therein, apparatus 50 is connected to a host computer 52 to receive the job data. Apparatus 50 includes document printer 56, which is preferably a laser printer including printer controller 58, a conventional document printer engine 60 and a mail finishing unit 64 which receives the printed documents from printer engine 60 and inserts them into envelopes to form mail pieces in accordance with the mail piece data.

Printer controller 58 receives job data 10 from host computer 52. When controller 58 includes the parsing interface, controller 58 parses the data; sending the attribute data from either job header 12 or mail piece header 18 to mail finishing unit controller 100 and sending document data 20 to document printer engine 60. Mail finishing unit controller 100 stores mail piece attributes from job header 12 for default control of the production of each mail piece.

Envelopes are printed by envelope printer 66, stored temporarily in a drying buffer station 68 and proceed to a flap opener station 72 where the envelope flap is opened prior to insertion of the printed documents and any other items, such as preprinted inserts.

At appropriate times, printer controller 58 outputs a page of document data to document printer engine 60 which prints that page in a conventional manner. As the page is printed it is received by accelerator station 76, and as printer engine 60 releases the printed page accelerator station 76 accelerates the page to the faster speed at which mail finishing unit 64 operates. Accelerator station 76 then transfers the printed page to accumulator station 78 and, if a plurality of pages are to be included in the mail piece the above described operations re repeated until all the document pages are in accumulator station 78. If the individual mail piece attributes specified for the mail piece by the control page 30 (or if the job attributes specified by job header 12) require a preprinted insert, such a preprinted insert may be fed from insert feeder 96 to accumulator station 78.

Once completed the accumulation of printing document pages and any preprinted inserts are transferred from accumulator station 78 to folder station 80 where the accumulation is folded into either a "C" or "Z" fold, as may be specified by the mail piece attributes of control page 30 or of the job header 12. Once the folded accumulation is present at folder station 80 the envelope, with its flap open, is fed to inserter station 82 and the folded accumulation is transferred thereto for insertion into the envelope. If specified by the mail piece attributes a BRE is fed from BRE feeder 98 and is also inserted into the envelope.

The mail piece (i.e., the envelope with all printed documents and any preprinted inserts and BRE's inserted) is fed from inserter station 82 to moistener station 84 where the envelope flap is moistened if the mail piece is to be sealed. The mail piece then proceeds to flap closer station 86, sealer 90 and output stacker 94 where the completed mail piece, including all preprinted inserts and BRE's is output for franking with the proper postage and delivery to the postal service. It should be recognized that, although the foregoing disclosure has identified a number of commands which may be incorporated in the control block 32 of a control page 30, the invention is not limited thereto and other commands may be included, to control operation of any device that may be useful in preparation of the mail piece. Thus, commands may be provided to select a printer; to control the drying time for ink jet printed documents and envelopes; to enable or disable printing of postage or to control the amount of postage to be printed; to control printing of pre-defined ad slogans along with postage indicia; to vary the number or contents of such slogans; to control stack offset of a mail piece thus to signal ZIP code breaks, to identify unsealed pieces, or otherwise to identify pieces requiring special operator attention; to control document length or to provide any other relevant control.

The foregoing description of the preferred embodiment of the invention has been presented for purposes of illustration and description and describes an integrated mail generation peripheral which supports direct connection to a variety of host environments. Through a single data stream, the invention enables a host application or driver to send data to control the formatting and printing of documents and matching envelopes as well as commands to control mail finishing operations. It is not intended to be exhaustive or to limit the invention to the precise forms disclosed, since many modifications or variations thereof are possible in light of the above teaching. All such modifications and variations are within the scope of the invention. The embodiments described herein were chosen and described in order best to explain the principles of the invention and its practical application, thereby to enable others skilled in the art to utilize the invention in various embodiments and with various modifications as are suited to the particular use contemplated therefor. It is intended that the scope of the invention be defined by the claims appended hereto, when interpreted in accordance with the full breadth to which they are legally and equitably entitled.

What is claimed is:

1. A mail production system for producing one or more mail pieces, said system further comprising:

(a) printer means for printing a set of one or more documents and a set of one or more envelopes in response to a first set of signals generated by a host data processing system under control of an application program;

(b) mail finishing means for forming one or more finished mail pieces from said set of one or more documents and said set of one or more envelopes;

(c) control means for controlling said printer means and said mail finishing means so as to produce said one or more finished mail pieces; said control means further comprising:

(i) signal receiving means for receiving a stream of signals from said host data processing system;

(ii) parsing means for parsing said received signal stream into a plurality of control streams and a print stream representing text to be printed and including a control page; said plurality of control streams further comprising:

(1) a stream of mail piece attributes for each individual mail piece;

(2) a stream of finishing control signals for controlling said finishing unit in the production of an individual mail piece;

(3) a stream of printing control signals for controlling said printer means in the printing of each individual envelope and each individual document; and (4) said control page within said print stream further comprising data signals representative of said individual document's format and including a set of control signals associated with said individual document.

2. An apparatus as recited in claim 1, wherein the application program is programmed for outputting to a printer document signals representing document pages to be printed, and said control means is programmed to respond to predefined document signals representing a predefined document format, output from the host computer by the application program, as control signals identifying said individual attributes, to generate said finishing control signals for said mail finishing means responsively thereto, and to extract said print signals for said print means from parts of said signals other than said predefined document signals thereby to prevent said print means from printing in response to said predefined document signals.

3. An apparatus as recited in claim 2, further comprising display means for interactively displaying to a user an attribute for assigning to said individual one of said plurality of mail pieces, and input means for receiving a user selection of attributes to be assigned to the individual one of said plurality of mail pieces, wherein said application program is programmed to respond to a user selection of a specific attribute by generating specific signals interpreted by said control means as specific finishing control signals for said mail finishing means to form said individual one of said plurality of mail pieces with said specific attributes.

4. An apparatus as recited in claim 1, further comprising display means for interactively displaying to a user an attribute for assigning to said individual one of said plurality of mail pieces, and input means for receiving a user selection of attributes to be assigned to the individual one of said plurality of mail pieces, wherein said application program is programmed to respond to a user selection of a specific attribute by generating specific signals interpreted by said control means as specific finishing control signals for said mail finishing means to form said individual one of said plurality of mail pieces with said specific attributes.

5. An apparatus as recited in claim 1, wherein the application program is a word processor programmed for outputting to a printer document signals representing document pages to be printed, and said control means is programmed to respond to predefined document signals representing a predefined document format, output from the host computer by the application program, by producing control signals identifying said individual attributes, to generate said finishing control signals for said mail finishing means responsively thereto, and to extract said print signals for said print means from parts of said document signals other than said predefined document signals thereby to prevent said print means from attempting to print document pages in response to said predefined document signals.

6. An apparatus as recited in claim 5, further comprising display means for interactively displaying to a user an attribute for assigning to said individual one of said plurality of mail pieces, and input means for receiving a user selection of attributes to be assigned to the individual one of said plurality of mail pieces, wherein said application program is programmed to respond to a user selection of a specific attribute by generating specific signals interpreted by said control means as specific finishing control signals for said mail finishing means to form said individual one of said plurality of mail pieces with said specific attributes.

7. An apparatus as recited in claim 1, wherein said finishing means comprises medium fold means for folding a medium to form an envelope in response to medium folding signals applied thereto; and said control means responds to said control signals by generating said medium folding signals in said finishing control signals, thereby variably controlling a fold applied to a medium to form envelopes for individual mail pieces.

8. An apparatus as recited in claim 1, wherein said finishing means comprises insert means for inserting a printed document in the envelope in response to insert signals applied thereto; and said control means responds to said control signals by generating said insert signals in said finishing control signals, thereby variably controlling a number of inserts added to individual mail pieces.

9. An apparatus as recited in claim 1, wherein said finishing means comprises folder means for folding a document for insertion in the envelope in response to fold signals applied thereto; and said control means responds to said control signals by generating said fold signals in said finishing control signals, thereby varying a fold applied to documents inserted in individual mail pieces.

10. An apparatus as recited in claim 1, wherein said finishing means comprises: medium fold means for folding a medium to form an envelope in response to medium folding signals applied thereto; insert means for inserting a printed document in the envelope in response to insert signals applied thereto; and folder means for folding a document for insertion in the envelope in response to fold signals applied thereto; and said control means responds to said control signals by generating said medium folding signals, said insert signals, and said fold control signals in said finishing control signals, thereby variably controlling a fold applied to a medium to form envelopes for individual mail pieces; variably controlling a number of inserts added to individual mail pieces, and varying a fold applied to documents inserted in individual mail pieces.

11. A method for producing mail pieces comprising the steps of:

(a) printing a plurality of documents and envelopes in response to a stream of signals generated by a host data processing system under control of an application program;

(b) forming a plurality of mail pieces from the documents and the envelopes by applying a finishing process thereto; said finishing process further comprising:

(i) forming an individual one of said plurality of mail pieces; wherein said individual one of said plurality of mail pieces comprises a set of individual attributes different from attributes of another one of said plurality of mail pieces;

(ii) receiving said signals generated by said host computer; receiving said stream of signals from said host data processing system (iii) parsing said received stream of signals into a plurality of control streams and a print stream representing text to be printed and including a control page and extracting therefrom control signals generated under control of said application program; wherein said plurality of control streams further comprises finishing control signals and print control signals;

(iv) identifying said set of individual attributes for said individual one of said plurality of mail pieces from said plurality of control streams;

(iv) responding to said control signals by generating said finishing control signals to form said individual one of said plurality of mail pieces with said set of individual attributes; and (v) extracting print signals from said signals and providing said print control signals for printing documents responsively thereto.

12. A method as recited in claim 11, wherein the application program is a word processor programmed for outputting document signals representing document pages to be printed, and including the further steps of:

responding to predefined document signals representing a predefined document format, output from the host computer by the application program, by producing control signals identifying said individual attributes and generating said finishing control signals responsively thereto, and extracting said print signals from parts of said document signals other than said predefined document signals thereby precluding an attempt to print document pages in response to said predefined document signals.

13. A method as recited in claim 11, wherein said finishing process comprises: folding a medium to form an envelope in response to medium folding signals applied thereto; inserting a printed document in the envelope in response to insert signals applied thereto; and folding a document for insertion in the envelope in response to fold signals applied thereto; and further comprising the step of responding to said control signals by generating said medium folding signals, said insert signals, and said fold control signals in said finishing control signals, thereby variably controlling a fold applied to a medium to form envelopes for individual mail pieces; variably controlling a number of inserts added to individual mail pieces, and varying a fold applied to documents inserted in individual mail pieces.

* * * * *